US007685945B2

(12) United States Patent
Norbury

(10) Patent No.: US 7,685,945 B2
(45) Date of Patent: Mar. 30, 2010

(54) DRAGSTRIP AMUSEMENT RIDE

(76) Inventor: Steven Norbury, 9601 Blue Spruce La., St. Jacob, IL (US) 62281

( * ) Notice: Subject to any disclaimer, the term of this patent is extended or adjusted under 35 U.S.C. 154(b) by 332 days.

(21) Appl. No.: 11/736,089

(22) Filed: Apr. 17, 2007

(65) Prior Publication Data

US 2008/0257196 A1 Oct. 23, 2008

(51) Int. Cl.
*A63K 1/00* (2006.01)

(52) U.S. Cl. ..... 104/60; 104/83; 104/84; 104/85

(58) Field of Classification Search ..... 104/60, 104/77, 53, 83, 84, 85; 472/85, 59, 60; 434/62
See application file for complete search history.

(56) References Cited

U.S. PATENT DOCUMENTS 5,865,624 A * 2/1999 Hayashigawa ..... 434/66
6,179,619 B1 * 1/2001 Tanaka ..... 434/69
6,910,972 B2 * 6/2005 Norbury ..... 472/85

* cited by examiner

*Primary Examiner*—Mark T Le
(74) *Attorney, Agent, or Firm*—Don W. Weber

(57) ABSTRACT

A drag strip race amusement ride runs on a straight-line track and is propelled to high rates of acceleration over the 150-foot racetrack. The vehicle cab seats nine. Each racer has an individual acceleration pedal. Located on the front windshield and on each side window is an LCD video screen. Audio sounds are also introduced into the cab during the ride. When the signal is given to begin the race, each racer hits his acceleration pedal. A central computer system synchronizes the video, audio, acceleration and deceleration so that the sensory perceptions of sight, sound and feeling of an actual drag strip race are created. A winner is determined by measuring the reaction time of each racer between the signal and the pedal.

4 Claims, 6 Drawing Sheets

*Fig.* 2

DRAGSTRIP AMUSEMENT RIDE

BACKGROUND OF THE DEVICE

This invention relates to the field of amusement rides. More particularly, a simulated dragstrip race is presented which provides audio, video and force-generating sensations for the riders.

The field of amusement rides has many different rides and nuances to rides. From the first roller coaster on Coney Island to the most recent Spaceship rides at newer amusement parks, the rides field has been one of innovation and advancements. Often new technology increases the resource with which the inventor has to work to improve the rides. A simple roller coaster is now a complicated stream of sensory perceptions including audio sounds, video illusions, smoke, water and even G-forces.

Since many amusement rides are only simulations of the actual sensations encountered in experiencing the real ride or event, one of the most important aspects of creating an amusement ride is to foster a feeling of realism in the ride. For example, three-dimensional screens may be used to simulate motion. Audio speakers and soundtracks may simulate the noises heard during the ride or event (e.g. a car race or an airplane ride). Some rides even allow for actual movement of the passenger compartment.

A patent of general interest in the amusement ride industry is U.S. Pat. No. 5,361,705 issued to Powell. Powell discloses a drag strip amusement ride where the driver interactively controls the acceleration, gear shifting and braking as if in actual control of the race. Powell uses an electrified track for propulsion. Another patent of interest is the one granted to the instant inventor in 2005 where a pneumatically driven cable propels the passenger compartment of the ride to speeds and hence G-forces that approximate the real forces encountered in a dragstrip.

Other prior art of interest includes the 1999 patent issued to Hayashigawa U.S. Pat. No. 5,865,624 and the 2001 US patent issued to Fritz (U.S. Pat. No. 6,227,120). The '624 patent is for a ride simulator where the actual ride in a racecar, speedboat, or other vehicle is simulated in a remote car. Hayashigawa uses video and audio broadcasting equipment from an actual dragster or racer and transmits data to the remote ride car. Hayashigawa also provides for the introduction of a sensory experience in the form of G-forces developed from a "motion base." However, in Hayashigawa, "the passenger moves only a short distance" and "the sights, sounds, and G-forces" are "within the limits of the base." This means that the G-forces simulated are only a small fraction of the actual G-forces in a drag race. It is an object of this invention to provide a dragstrip amusement ride where speeds approaching the actual speeds of a dragstrip race and G-forces approaching the actual forces encountered in a dragstrip race are simulated.

Fritz discloses an amusement ride capable of generating a natural "wheelie" motion, although "minimal acceleration" is involved. Fritz generates only about one-half Gs on the track. Fritz has no interactive content and has no audio or video component, as does your invention. It is another object of this invention to provide a simulated dragstrip ride with active controls for manipulation by the riders, acceleration approaching the actual acceleration of a dragstrip race, smoke for start-up, lights to begin the race, shifting controls, audio sounds simulating the entire length of the race, surround video for the entire length of the track and other sensory sensations to provide the most realistic dragstrip amusement ride yet produced.

Simulated rides of other events are known in the prior art. A realistic roller coaster simulator is disclosed in the 1999 patent issued to DiNunzio (U.S. Pat. No. 6,007,338). DiNunzio provides for synchronized audio and visual effects for a roller coaster ride. Upon starting the ride, "the passenger can experience in real time the visual, motive, audible and other effects (such as wind, heat, cold, water, etc.)." DiNunzio uses a "means for moving the passenger compartment to simulate the motion of a roller coaster." As entertaining as the DiNunzio ride is, his passenger compartment does not move from its base. Since it does not move from its base, the actual G-forces of acceleration, deceleration and longitudinal motion are not as realistic as in the instant invention. It is a still further object of this invention to provide a simulated dragstrip ride where the noises, smells, sight, acceleration deceleration and linear movement of an actual dragstrip is created.

The prior art discloses many unique amusement rides, some of which include a simulation of slight G-forces or other audio, sight, or movement sensations. Audio and video simulators are known in the art. Simulating motion or partial G-forces are known in the art. Drag strip simulation amusement rides are known in the art. However, it a still further object of this invention to provide a simulated dragstrip amusement ride with a cabin surrounded by video, audio and other sensory sensations to simulate the sight, sound and smell sensations of an actual dragstrip race while the simultaneous rapid linear movement, acceleration and deceleration of the passenger cabin to high speeds results in G-forces approximating the actual G-forces of a real dragstrip race.

Other and further objects of this invention will become apparent upon reading the below Specification.

BRIEF DESCRIPTION OF THE DEVICE

A drag strip ride simulates the actual sights, sounds acceleration, deceleration and other sensory perceptions of a real drag race. The multiple occupant vehicle has seats for nine individual racers. The seats simulate the vibration encountered during an actual drag race. Each racer has an acceleration pedal connected to a centralized computer system. A signal light warns each racer before the race starts that the race is about to begin. A racer who activates his pedal too soon is penalized. Each racer's pedal is linked to a centralized computer to determine which racer activated his pedal the quickest after the green go light signals the start of the race. The vehicle cab also has front and side LCD or other video screens that display simulated sights of an actual drag race. Audio sounds simulating the actual sounds of a real drag race are also introduced into the vehicle cab. When the race starts, the vehicle accelerates rapidly down a straight-line track at speeds sufficient to generate G forces approximating the actual G forces of a real drag race. The central computer system synchronizes the video, audio, acceleration and other sensory perceptions of the device to create a real life experience of a drag race.

BRIEF DESCRIPTION OF THE DRAWING FIGURES

DETAILED DESCRIPTION OF THE PREFERRED EMBODIMENT

This simulated dragstrip amusement is an improvement and further enhancement over my previous U.S. Pat. No. 6,910,972 issued to me on Jun. 28, 2005. The previous disclosure for a side-by-side simulated dragstrip ride directed itself mainly to the propulsion means, the track, and several enhancements to the entire experience. For a good description of the track, drive means and other related mechanism, see my prior US patent, particularly Columns 7-12.

Figure 1:
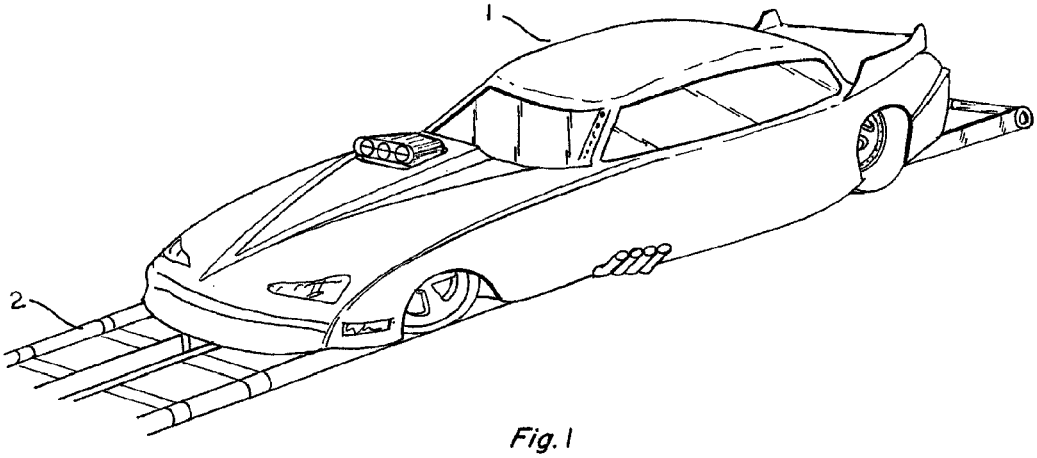
FIG. 1 is a perspective view of the device showing the drag race vehicle and racetrack.
Figure 2:
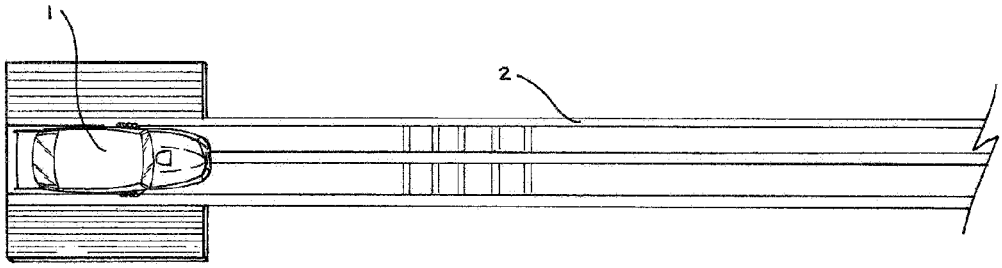
FIG. 2 is a top view of the racetrack and vehicle.
Figure 3:
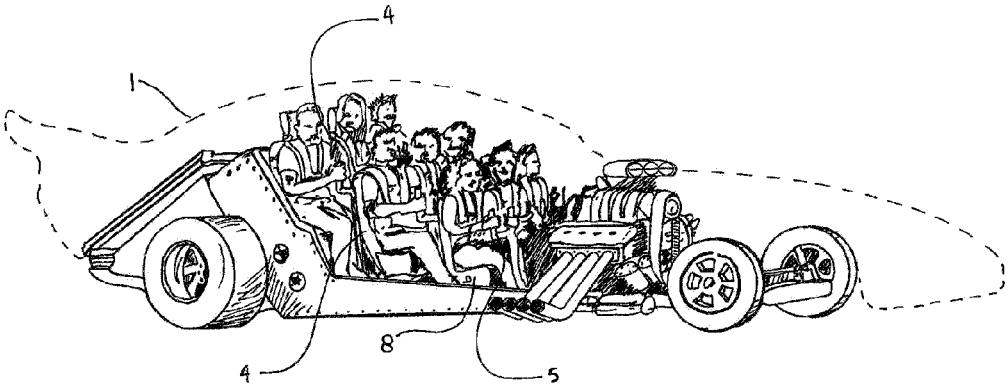
FIG. 3 is a side perspective cutaway view of the vehicle showing the passenger cab area with the vehicle body in phantom lines.
Figure 4:
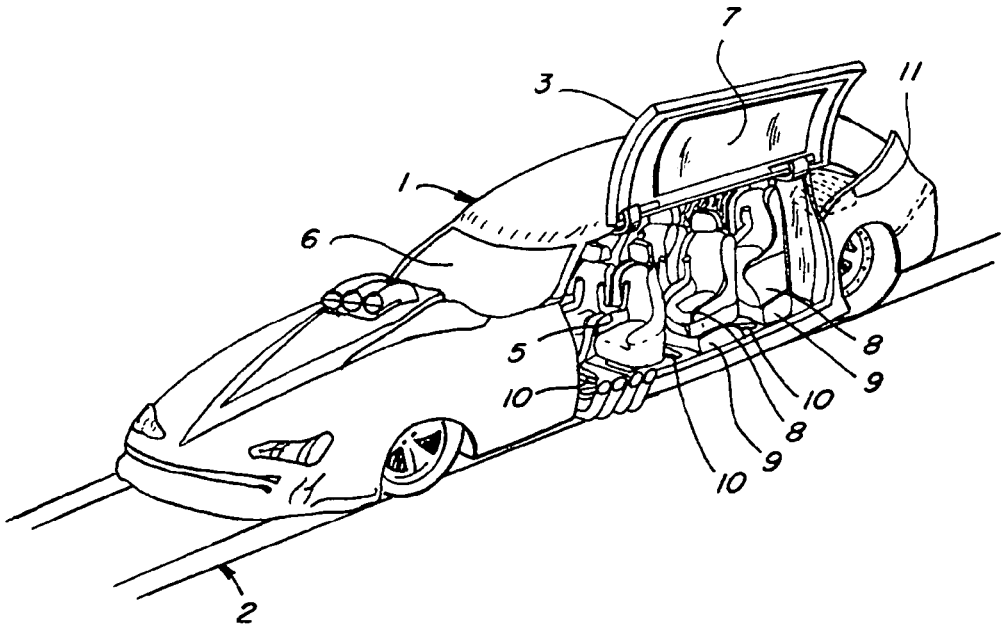
FIG. 4 is a side perspective view of the vehicle with the left side door open.
Figure 5:
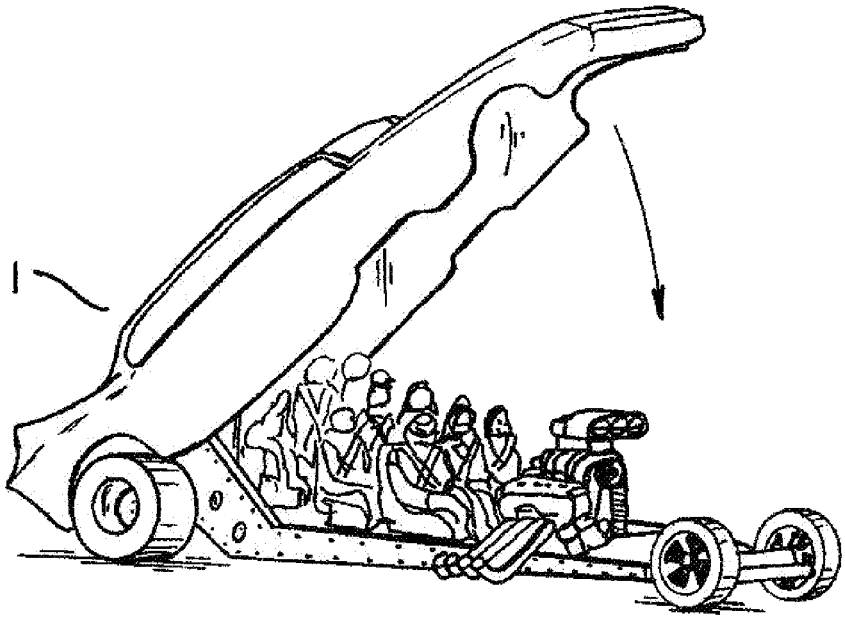
FIG. 5 is a perspective view of an alternate embodiment of the vehicle showing an alternative entrance and egress means.

The new improvements to my general concept have been developed to fully simulate the dragstrip race experience. The instant application discloses a one-car dragster 1 run on a single track 2 down an approximately 150-foot racetrack. The new nine-passenger vehicle is shown in FIG. 1. The nine-passenger dragster 1 is typically constructed to simulate the form of a real dragster as shown. It has side-opening doors 3 which allow the passengers to enter and exit the vehicle. For loading and unloading, the car is located next to a dock that is level with the floor of the car. A lighted Christmas tree tower, located near the Start line on the video screen, has three stages of lights for starting the race.

Figure 6:
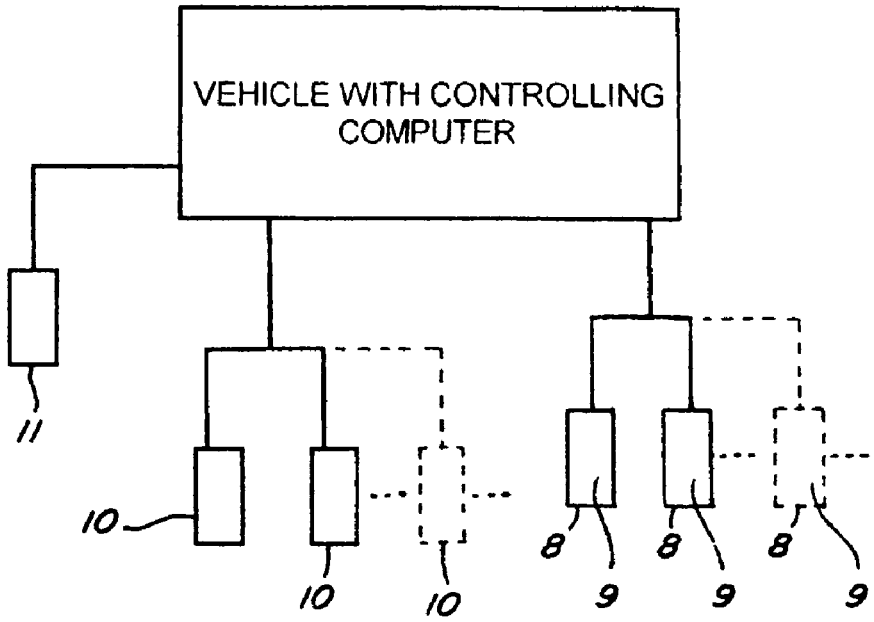
FIG. 6 is a schematic view showing a vehicle and its components.

Once inside the race participant cab, the race participants are seated and a lap bar or harness 4 is positioned over each racer's lap. Although a lap bar is preferred, it is also within the contemplation and disclosure of this invention that a shoulder harness 4 be used to secure each race participant. Unlike my prior dragstrip racing cars, each participant in the instant race has a "steering wheel" 5 and an acceleration pedal 10 (FIG. 6). The acceleration pedal 10 is located on the floor of each seat.

There could be as many as nine steering wheels 5 and nine acceleration pedals located in the participant cab. The steering wheels for each racer would be non-functional since the vehicle is moved along a single track by a pneumatic or other propulsion mechanism as previously disclosed in the art. However, each racer's individual acceleration pedal is connected to the central computer module. The functioning of the acceleration pedals will be explained later.

Affixed to the windshield 6 and side windows of the vehicle is front windshield video screen, driver's or left side video screen 7, and passenger or right video screen (not shown). These video screens are flat screen LCD or other type of video screens in the preferred embodiment. The video screens simulate the entire drag race from start to finish. They are coordinated to simulate the beginning rest location along the racetrack, the burnout and engine revving, the acceleration down the track and the deceleration at the Finish line. Unlike other dragstrip amusement rides, the racers in the instant device see visually everything that a real drag racer would see. The videos add to the simulation in that the scenery seen from the windshield and out the side windows is authentic.

The drag race vehicle 1 proceeds down a single track that is approximately 150 feet in length in the preferred embodiment. The length of the racetrack (150 feet) allows for the easy transportation and set-up of the ride at multiple places. Due to this versatility in the nature and size of the ride, the entire ride is easily portable.

The drive system of this device is capable of accelerating the dragster to a speed of approximately forty miles per hour in approximately two seconds. This very rapid acceleration creates approximately two Gs of force on the occupants of the cab. These G-forces approximate the forces on a real drag racer. However, to add to the realism of the drag race ride, motion seats 8 are also provided. These motion seats 8 have small electric motors 9 (FIG. 6) in them that vibrate the seats to simulate the vibration encountered in an actual drag race. The intense sensation created by the rapid acceleration and vibration of the seats accurately simulates the real sensations experienced by a real drag racer.

An added feature of this device is the audio sound system 11 (FIG. 6) simulation of an actual drag race. When the vehicle is in the ready position at the Start line, the vehicle simulates the burnout of its tires. This burnout is accompanied by a loud noise simulating actual burnout and smoke emanating from the bottom rear of the vehicle. Audio sounds simulating the idling and revving of the engine is also introduced into the participants' cabin area at appropriate times. When the race begins, the sounds of acceleration are introduced into the cab. Along the racetrack the racers also hear sounds simulating moving rapidly down the track and stopping. All of the audio sounds of a real drag race, from start to finish, are introduced into the participant's cab before, during and after the race. Crowd noises may also be supplied.

The Christmas tree start tower has three stages of lights. Prestage yellow lights signal the racers that the race is about to begin. The next Staging lights signal the racers to get ready to push quickly down on the acceleration pedal when the lights turn to green. The green lights signal the start of the race. All nine acceleration pedals are connected to a computer module. Electronic pedal sensors and the computer module are able to measure the exact time when each racer activates his "acceleration" pedal. If a racer hits his acceleration pedal before the green lights of the Christmas tree start the race, he is penalized approximately 0.04 seconds. This timing penalty is usually enough to insure that an early racer does not win the race. Of those race participants who activated their acceleration pedal after the green lights signal the start of the race, the racer who first activates his pedal is designated the winner at the end of the race. At the end of the race, an electronic scoreboard connected electrically to the computer module displays the winning racer's number and displays his winning simulated time.

Due to the moving audio and video components of this device, a continuous 110 volts must be supplied to the vehicle. Supplying electricity to the moving vehicle is accomplished by locating an electrified rail between the tracks under the vehicle. The vehicle has a hook up to the electrified rail similar to an electrified railroad or subway car.

A central operating and controlling computer and computer hookups are required to synchronize the various components of this device. The central computer controls and coordinates the sights, sounds, acceleration and deceleration of the vehicle during the ride. It is important that the video screens, the audio sounds and the actual acceleration and deceleration be completely synchronized with the drag race experience. In addition, the racing simulation after the green lights must also be synchronized with the first acceleration pedal after the green lights are activated. All of this is accomplished by the use of the central computer system.

Unique to the instant invention is the combination of surround video synchronized with audio simulations of a drag race and actual movements of the racers' vehicle at speeds approximating the speed and G-forces of a real drag race. The description herein provided is of the preferred embodiment and is meant as an illustration only and not as a limitation. Slight variations of the parts or functions of the essential elements are within the spirit and disclosure of this Specification. For example, it is not necessary that the propulsion means be by compressed air. Other means of accelerating the vehicle rapidly are within the contemplation of this invention, such as electric or magnetic propulsion or other means. What is important is that the cab be accelerated rapidly to approximate the actual G forces experienced in a drag race.

Having fully disclosed my device, I claim:

1. A dragstrip amusement ride for simulating the sights, sounds, vibrations and G-forces of a rider, comprising:

(a) a one-car dragster vehicle, having a race participant cab with more than two individual seats, located on a single linear track approximately 150 feet in length wherein said vehicle is accelerated to approximately 40 mph in 2 seconds to simulate the G forces actually experienced in a drag race;

(b) front windshield and left and right side synchronized video screens on the inside of said race participant cab wherein said video screens simulate the beginning rest location along the racetrack, the burnout and engine revving, the acceleration down the linear track and the deceleration at the Finish line of a drag race;

(c) an audio sound system capable of introducing synchronized simulated drag race audio sounds into said race participant cab wherein when said vehicle is in the ready position said sounds simulate the burnout of the tires and the idling and revving of the engine, and wherein when the race begins said sounds simulate the acceleration of the vehicle, and wherein as the vehicle moves along the linear track said sounds simulate moving rapidly down the track and stopping;

(d) an acceleration pedal for each participant in said cab, wherein each acceleration pedal is electrically connected to a central vehicle operating and controlling computer wherein after the signal for the start of the race, the participant who first activates his pedal is designated the winner after the race;

wherein said video screens and audio sounds are synchronized to the linear position of the vehicle on the approximately 150 foot track.

2. A dragstrip amusement ride for simulating the sights, sounds and vibrations and G-forces of a rider as in claim 1, further comprising a motion vibrator for said seats to simulate the vibration actually encountered during an actual drag race.

3. A dragstrip amusement ride for simulating the sights, sounds and vibrations and G-forces of a rider as in claim 1, further comprising a signaling device located on the video screen to signal the start of the race, wherein an said acceleration pedal is activated by each racer at the beginning of the race.

4. A dragstrip amusement ride for simulating the sights, sounds and vibrations and G-forces of a rider as in claim 3, wherein a racer is penalized when he activates his acceleration pedal before the start signal is given.

* * * * *